US006022128A

United States Patent [19]

Chi

[11] Patent Number: 6,022,128

[45] Date of Patent: Feb. 8, 2000

[54] NIGHT LAMP DEVICE

[76] Inventor: James Chi, 17 Chung-Shing Rd., Tu-Cheng, Taipei Hsien, Taiwan

[21] Appl. No.: 09/166,182

[22] Filed: Oct. 5, 1998

[51] Int. Cl.[7] ..... F21V 21/28

[52] U.S. Cl. ..... 362/276; 362/226; 362/802

[58] Field of Search ..... 362/276, 226, 362/802, 806; 439/289, 292, 366

*Primary Examiner*—Cassandra Spyrou
*Assistant Examiner*—Fayez Assaf
*Attorney, Agent, or Firm*—Smith, Gambrell & Russell, LLP

[57] ABSTRACT

A night lamp includes a lamp that is fitted to a lamp holder, on the lamp holder and in front of the lamp is installed a semi-transparent obstructing plate, in the front of the lamp holder is a light sensitive resistor, in the rear of the lamp holder is a plug that can be inserted into a household power supply socket, the light sensitive resistor on the lamp holder will sense the outside light source, so that it will automatically light on the lamp on the lamp holder; characterized in that at the rear of the lamp holder is a cylinder, on the bottom of its inside are a center contact point and a ring contact point, inside the cylinder is a turning disc, on the turning disc are two conductive pins, the two conductive pins are respectively in contact with the center contact point and the ring contact point; on the bottom side in the cylinder is a jutted point, on the bottom of the turning disc are no less than four equally spaced positioning holes, the jutted point will be accommodated in one of the positioning holes on the bottom of the turning disc, so that the socket will be turned in position and be inserted in a household power supply socket.

2 Claims, 4 Drawing Sheets

NIGHT LAMP DEVICE

BACKGROUND OF THE INVENTION

The present invention relates to a lamp device, particularly to a night lamp with a plug at the rear of a lamp holder that can be turned in different directions, so it can be turned in position as per one's wish and inserted in a household power socket.

As shown in FIG. 4, a conventional night lamp involves a lamp (b) that is fitted on a lamp holder (a). On the lamp holder (a) and in front of the lamp (b) is installed a semi-transparent obstructing plate (c). In front of the lamp holder (a) is a light sensitive resistor (d). At the back of the lamp holder (a) is a plug (e) that can be inserted in a household power supply socket. The light sensitive resistor (d) on the lamp holder (a) will sense the outside light source, so it will automatically light on the lamp (b) on the lamp holder (a).

But the direction of the household power socket may be either horizontal or vertical, while the plug (e) at the rear of the lamp holder (a) of a conventional night lamp is of a fixed type, therefore, the night lamp will only be inserted in the direction of the socket, in case the direction of a household power socket is different from that of the plug (e) of a night lamp, then the direction of the semi-transparent obstructing plate (c) in front of the night lamp will be different from the direction of a normal application, which will affect the beautiful appearance of its application.

Furthermore, the light sensitive resistor (d) in front of the lamp holder (a) in a conventional night lamp is exposed, but in fact due to the problem of the sensitivity of the light sensitive resistor (d), i.e. in case the light sensitive resistor (d) with a higher sensitivity is used, it will be conducted to light on the lamp (b) even in a dim light that is not completely dark, then it will waste electrical energy; meanwhile, in case the light sensitive resistor with a low sensitivity is used, then it will not normally react to the outside light source, then the lamp (b) could not normally be lighted on, and it will result in trouble in application.

The plug (e) on a conventional night lamp is made in a fixed direction, while the direction of a household power socket may be different, because of such a difference of direction designed for its obstructing plate (c), it will affect the beautiful of its application; and, the light sensitive resistor (d) used on the night lamp is exposed, too high or too low sensitivity will fail to react to the outside environment, which will cause trouble in application. In view of the above shortcomings, the inventor has dedicated in the research and design of a new night lamp, involving a lamp to be fitted on a lamp holder. On the lamp holder and in front of the lamp is installed a semi-transparent obstructing plate. In front of the lamp holder is installed a light sensitive resistor. At the rear of the lamp holder is installed a plug that can be inserted in a household power socket. The light sensitive resistor on the lamp holder will sense the outside light source to automatically light on the lamp on the lamp holder; characterized in that at the rear of the lamp holder is a cylinder, on the bottom inside which are a center contact point and a ring contact point. Inside the cylinder is a turning disc. On the turning disc are two conductive pins, the two conductive pins are respectively in contact with the center contact point and the ring contact point. On the bottom inside the cylinder is a jutted point. On the bottom of the turning disc are no less than four equally spaced positioning holes. The jutted point will be accommodated in one of the positioning holes on the bottom of the turning disc. On the obstructing plate is fitted a collar. The collar is located in front of the light sensitive resistor. The collar has a light reflecting surface in the inside wall thereof will converge the light, so that it will not light on the lamp when the outside light source is dim but not completely dark, and will light on the lamp when the outside environment has become completely dark.

SUMMARY OF THE INVENTION

The primary objective of the present invention is to provide a night lamp with a plug at the rear of a lamp holder that can be turned in different directions, so it can be turned in position and inserted in a household power socket.

Another objective of the present invention is to provide a night lamp with a collar having a light reflecting surface on the inside wall of an obstructing plate. The collar is located in front of the light sensitive resistor. The collar with a light reflecting surface will converge the light source, so that it will not light up the lamp when the outside environment is dim but not completely dark, and that it will only light up the lamp when the outside environment has become completely dark.

For better understanding of the present invention, the following drawings are described in details.

DETAILED DESCRIPTION OF PREFERRED EMBODIMENT

Figure 1:
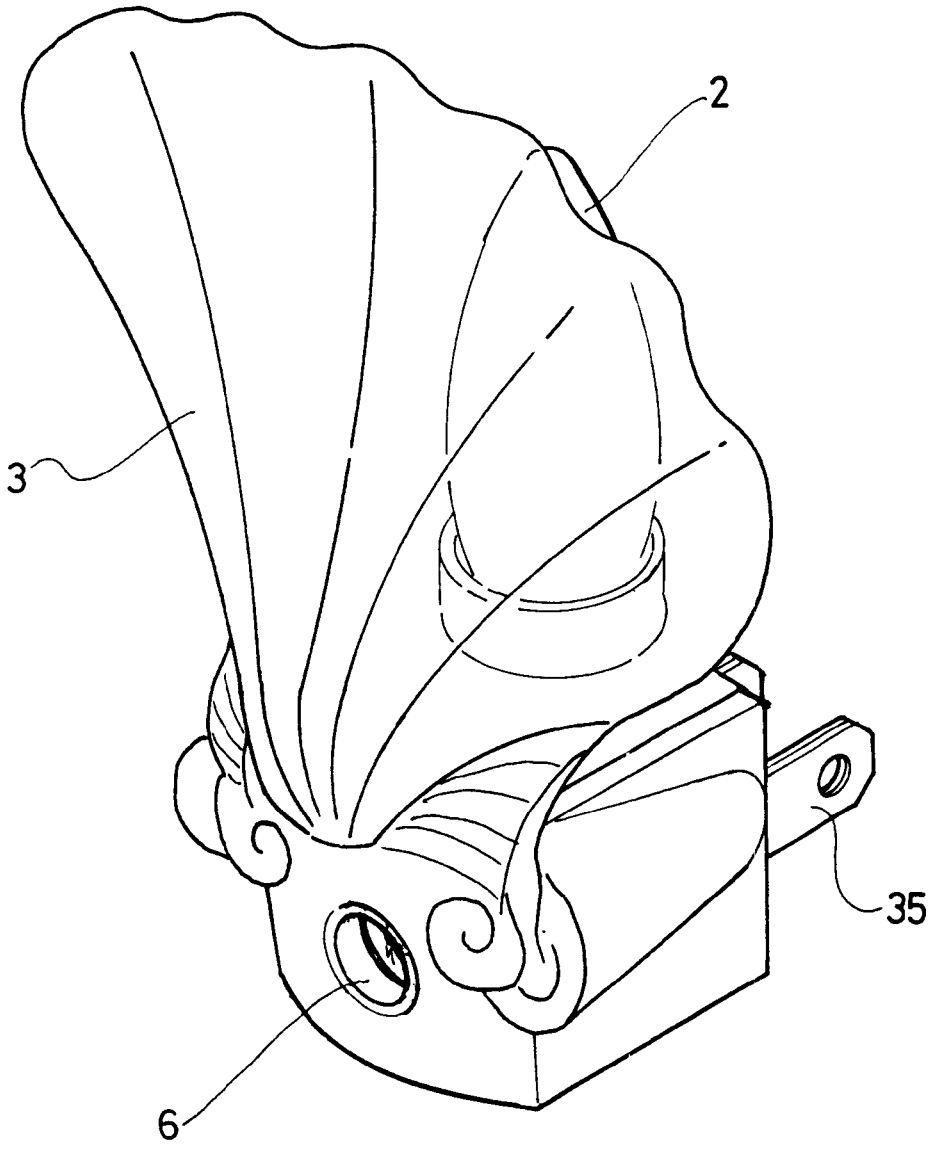
FIG. 1 is a perspective view of the invention.
Figure 2:
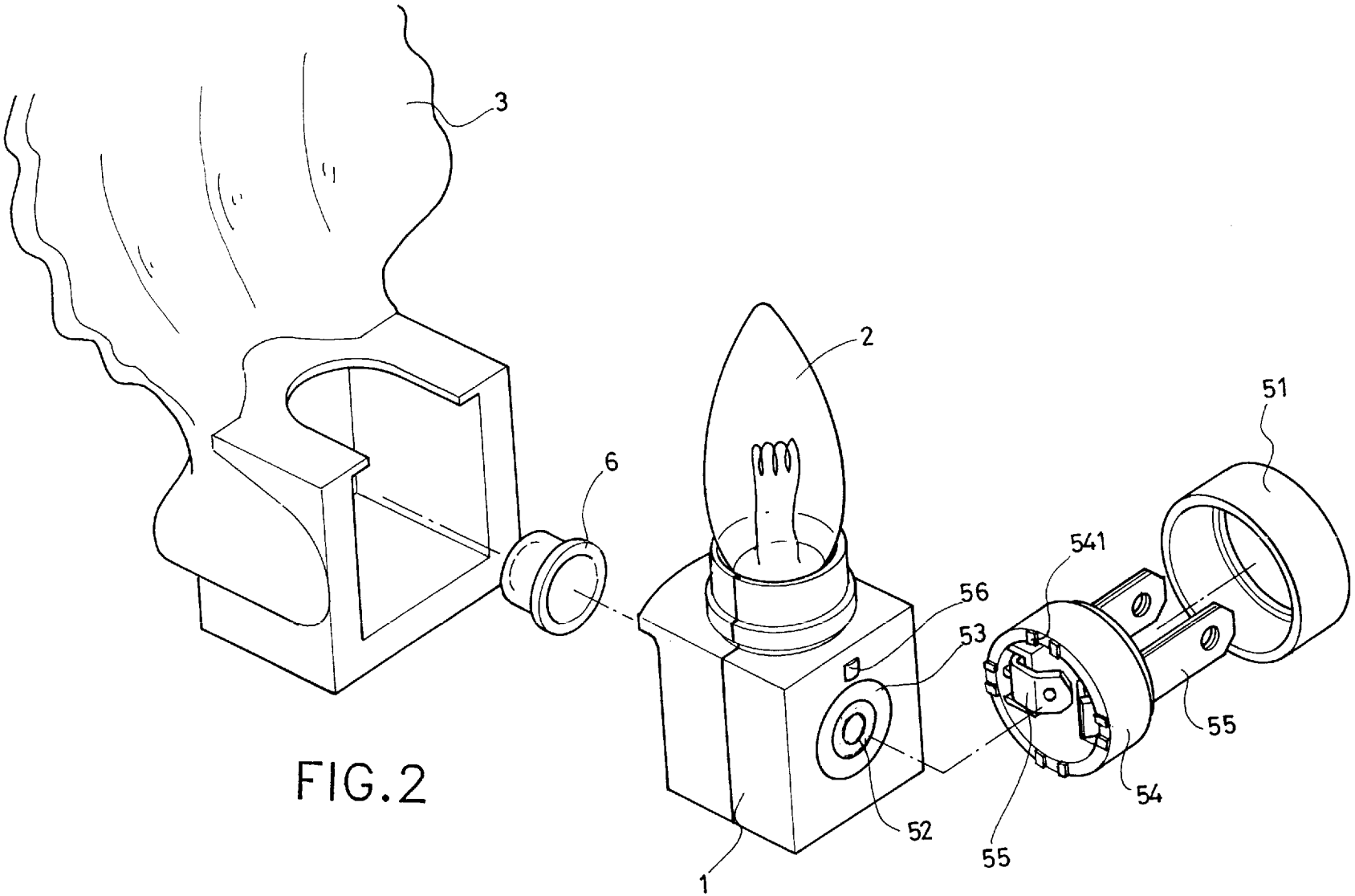
FIG. 2 is an exploded view of the invention.

First, please refer to FIGS. 1 and 2, a night lamp of the present invention comprises a lamp holder 1 having a lamp 2 fitted theron. On the lamp holder 1 and in front of the lamp 2 is a semi-transparent obstructing plate 3. In the front of the lamp holder 1 is a light sensitive resistor 4. At the rear of the lamp holder 1 is a plug 5 that can be inserted in a household power socket. The light sensitive resistor 4 on the lamp holder 1 will detect an outside light source, so the lamp 2 on the lamp holder 1 will be automatically lit during nighttime; characterized in the following:

The plug 5 includes a cylinder 51 at the rear of the lamp holder 1. On its inside bottom and at the rear of the lamp holder 1 are a center contact point 52 and a ring contact point 53. Inside the cylinder 51 is a turning disc 54. On the turning disc 54 are two conductive pins 55. The bottom ends of the two conductive pins 55 are respectively connected to the center contact point 52 and the ring contact point 53. On the bottom inside the cylinder 51 and at the rear of the lamp holder 1 is a jutted point 56. On the bottom side of the turning disc 54 are no less than four equally spaced positioning holes 541. The jutted point 56 is accommodated in the positioning holes 541 on the bottom of the turning disc 54, so the plug 5 may be turned and positioned.

Figure 3:
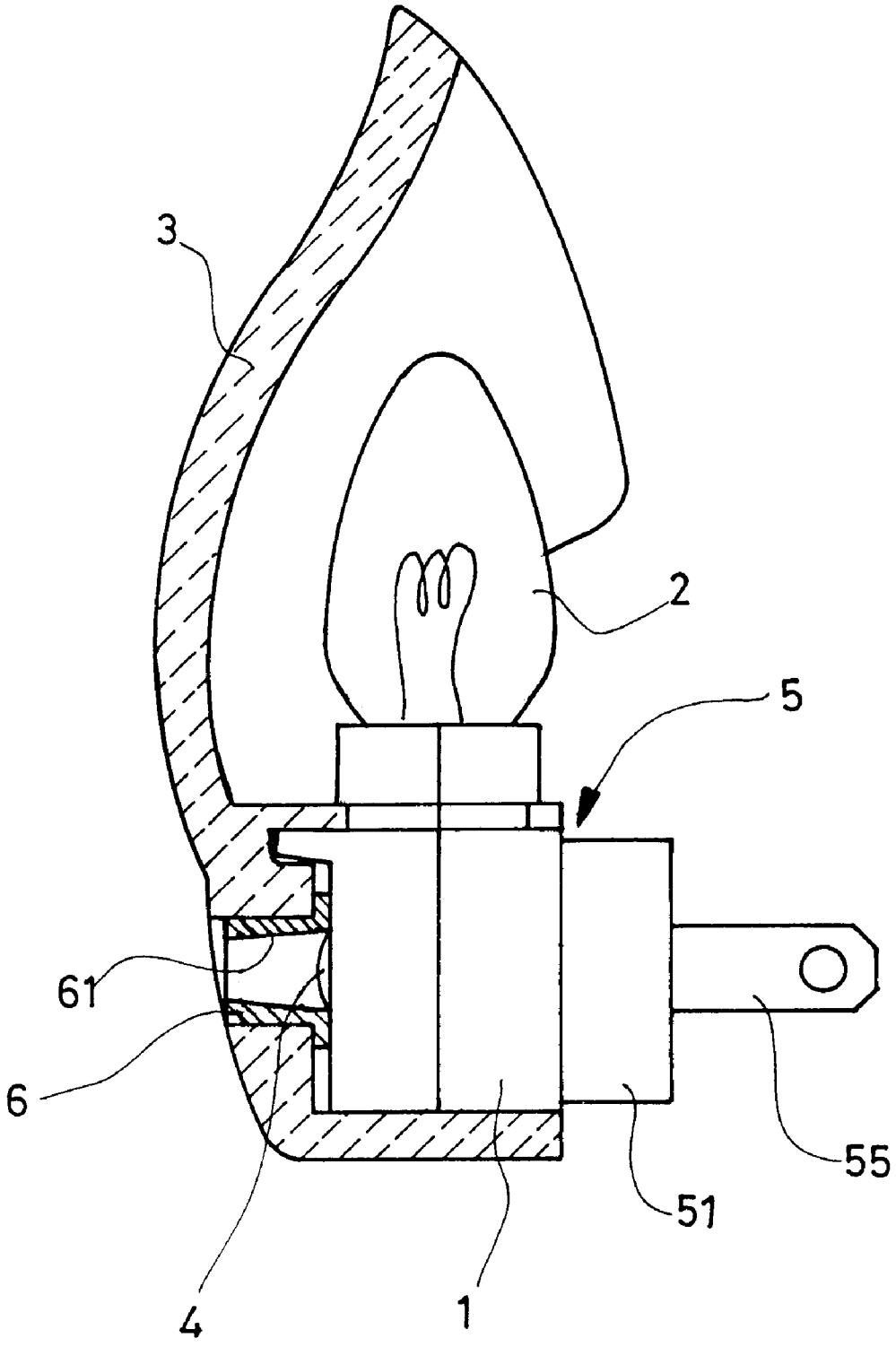
FIG. 3 is a section view of assembly of the invention.
Figure 4:
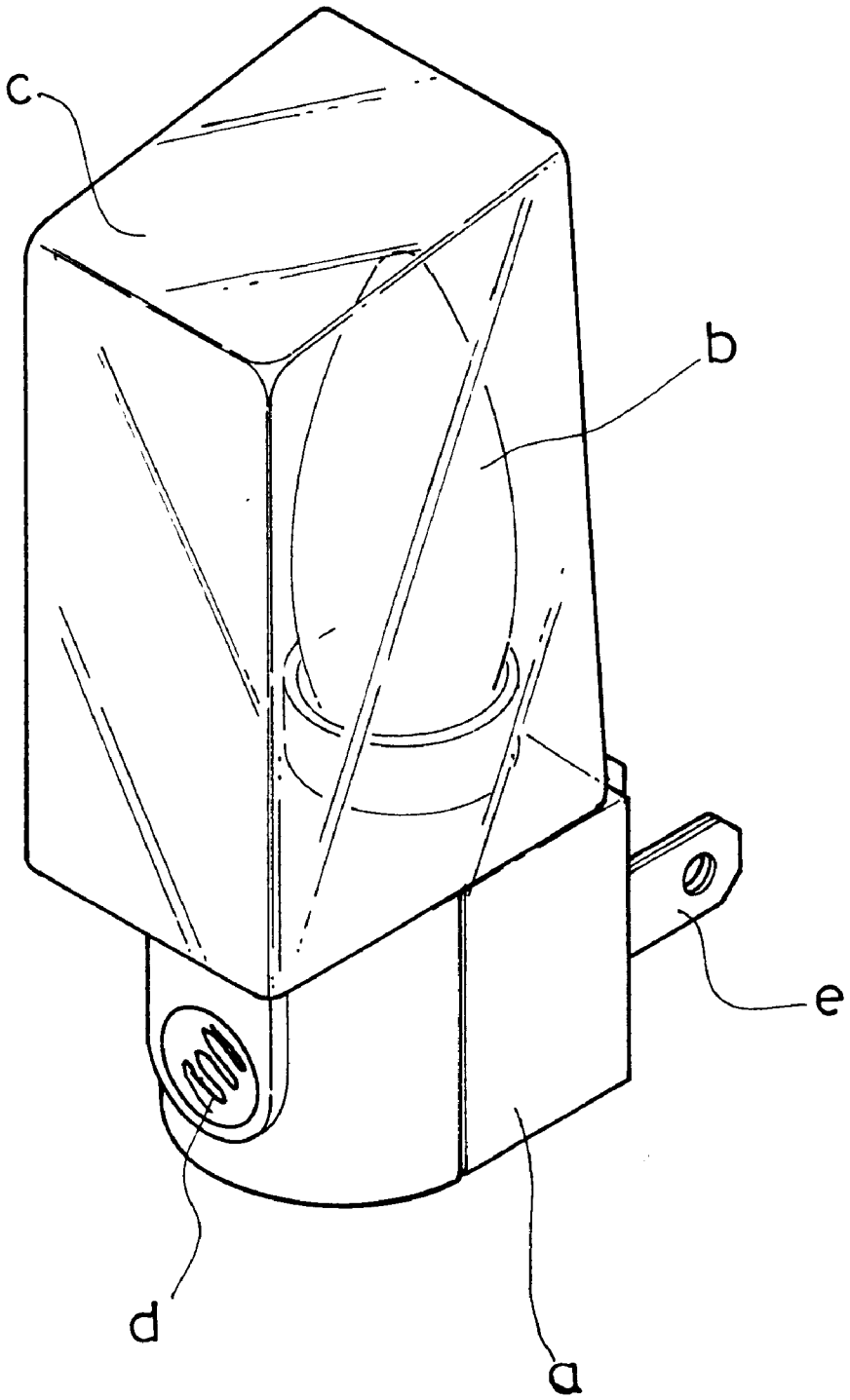
FIG. 4 (PRIOR ART)
FIG. 4 is a perspective view of a prior art.

On the obstructing plate 3 is installed a collar 6. The collar 6 has a reflecting surface 61 on its inside wall. The inside diameter of the light reflecting surface becomes gradually larger and larger from the outward to the inward thereof. The collar 6 is located in front of the light sensitive resistor 4, as shown in FIG. 3.

With the aforementioned structure, in case a household power socket (not shown in drawing) is installed in a different direction, the turning disc 54 at the rear of the lamp holder 1 can be rotated to align the conductive pins 55 in the same direction with the household socket. The turning disc 54 will be positioned securely when the jutted point 56 is accommodated in one of the positioning holes 541 on the bottom of the turning disc 54, then the turning disc 54 is fixed in a specific direction, so the obstructing plate 3 in front of the lamp holder 1 will maintain its normal position, so the direction of the plug 5 can be turned to suit the direction of a household power socket.

Furthermore, since the turning disc 54 is rotatable in 360 degrees, and in order to keep the two conductive pins 55 being in contact with the circuit inside the lamp holder 1, so on the bottom of the cylinder 51 in the rear of the lamp holder 1 are mounted a center contact point 52 and a ring contact point 53. The two conductive pins 55 may be in contact respectively with them, so when the turning disc 54 is rotated, the two conductive pins 55 are contacted and conducted with the center contact point 52 and the ring contact point 53.

On the light sensitive resistor 4 in the front of the lamp holder 1 is a collar 6 with a light reflecting surface 61 on its inside wall. Since the light reflecting surface 61 in the collar 6 is shaped larger and larger from outwards to inwards, so it can converge light, in case the outside light is dim but not completely dark, since the light sensitive resistor 4 is capable of sensing an illumination higher than the outside light source, so the light sensitive resistor 4 will be kept in its open circuit status, in case the outside light source has become completely dark, then the light sensitive resistor 4 will be conductive to light up the lamp 2; so it will avoid lighting up the lamp 2 when the surrounding illumination is still visible, this will save electrical energy, and the night lamp will light up the lamp 2 only when necessary.

I claim:

1. A night lamp device comprising a lamp holder having a lamp thereon, on said lamp holder and in front of said lamp being installed a semi-transparent obstructing plate, in the front of said lamp holder being installed a light sensitive resistor, in the rear of said lamp holder being installed a plug to be inserted in a household power supply socket; through said light sensitive resistor on said lamp holder sensing the outside light source, said light sensitive resistor automatically lighting up said lamp on said lamp holder at night;

said plug including a cylinder on the back of said lamp holder, on the bottom inside said cylinder and in the rear of said lamp holder being a center contact point and a ring contact point, inside said cylinder being a turning disc, on said turning disc being fitted two conductive pins, the bottom ends of said two conductive pins being respectively contacted and conducted to said center contact point and ring contact point; on the bottom inside said cylinder and in the rear of said lamp holder being a jutted point, on the bottom side of said turning disc being disposed not less than four equally spaced positioning holes, said jutted point being accommodated onto one of said positioning holes on the bottom of said turning disc, so said plug being able to be turned and positioned.

2. A night lamp device as cited in claim 1, wherein a collar being installed on said obstructing plate, said collar having a light reflecting surface thereon, the inside diameter of said light reflecting surface being gradually larger and larger from outwards to inwards, and said collar being located in front of said light sensitive resistor.

* * * * *